US007966911B2

(12) United States Patent
Thayer

(10) Patent No.: US 7,966,911 B2
(45) Date of Patent: Jun. 28, 2011

(54) HOSE CLAMP REMOVAL AND INSTALLATION TOOL

(75) Inventor: Richard D. Thayer, Bellevue, WA (US)

(73) Assignee: Lisle Corporation, Clarinda, IA (US)

( * ) Notice: Subject to any disclaimer, the term of this patent is extended or adjusted under 35 U.S.C. 154(b) by 290 days.

(21) Appl. No.: 12/424,173

(22) Filed: Apr. 15, 2009

(65) Prior Publication Data

US 2009/0199681 A1 Aug. 13, 2009

Related U.S. Application Data

(63) Continuation-in-part of application No. 11/509,943, filed on Aug. 25, 2006, now abandoned.

(60) Provisional application No. 60/596,316, filed on Sep. 15, 2005.

(51) Int. Cl.
*B25B 27/10* (2006.01)
*B25B 25/00* (2006.01)

(52) U.S. Cl. ..... 81/9.3; 81/485; 81/486; 29/225; 29/229

(58) Field of Classification Search ..... 81/9.3, 81/485–486, 424.5, 426.5, DIG. 4; 269/252–253; 29/225, 229, 243.56
See application file for complete search history.

(56) References Cited

U.S. PATENT DOCUMENTS 1,982,630 A * 12/1934 Bent ..... 140/93 R
2,910,899 A 12/1958 Pasqualone et al.
4,341,375 A * 7/1982 Romanin ..... 269/43
6,164,162 A 12/2000 Furundzic
6,370,985 B1 * 4/2002 Wu ..... 81/9.3
2002/0178869 A1 * 12/2002 Pool et al. ..... 81/9.3

OTHER PUBLICATIONS

Thexton—Hose Clamp Tool, SKU No. THX461 retrieved from http://www.geeinc.com/detail.aspx?ID=214035 retrieved Jun. 8, 2006.

KD Tools 3444—Plier Hose Clamp Large; Mayhew Tools 28655-2 Piece Hose Clamp Pliers Kit; SK Hand Tools 7408—Hose Clamp Pliers 8 in; Mayhew Tools 28650—Spring Loaded Cable Hose Clamp; Schley Products Inc. 95600—Hose Clamp Pliers Adjustable Straight; retrieved from http://www.sjdiscounttools.com/vehicle-specialty-tools-hose--tubing--vacuum-system-tool retrieved on Jun. 8, 2006.

(Continued)

*Primary Examiner* — D. S Meislin
(74) *Attorney, Agent, or Firm* — Banner & Witcoff, Ltd.

(57) ABSTRACT

A hose clamp compression tool for engaging and compressing opposed or opposite end tangs of a hose clamp includes a first fixed plate and jaw and a second fixed plate spaced from the first fixed plate and jaw. The first and second plates are mounted on rails with a sliding plate and jaw also mounted on the rails and positioned between the fixed plates. The sliding plate is rotatably adjustable in spacing from the one fixed plate by means of a threaded rod journaled to the fixed plates and threaded to the sliding plate. The jaws each include both a transverse slot cooperative with an end tang of a band type hose clamp and a channel extending from the slot for engagement with the end tang of a ring or wire type hose clamp thereby enabling use of the tool for either a band type or a wire type hose clamp.

6 Claims, 6 Drawing Sheets

OTHER PUBLICATIONS

SK Hand Tool 90245—Flex-Cable Hose Clamp Pliers; KD Tools 429 Hose Clamp Pliers; Schley Products Inc. 95640—Hose Clamp Pliers Adjustable 90 Degree; Astro Pneumatic 9409—Flexible Hose Clamp Pliers; KD Tools 3252—Flat Band Hose Clamp Pliers; Knipex GR139-10—Hose Clamp Plier; Schley Products Inc. 95660—Hose Clamp Pliers; retrieved from http://www.sjdiscounttools.com/vehicle-specialty-tools-hose--tubing--vacuum-system-tool retrieved on Jun. 8, 2006.

Hose Clamp Tool small #71455 and large #71457 retrieved from http://www.steckmfg.com/71459_HoseClamp.html retrieved on Sep. 25, 2007.

Hazet—Hose Clamp Tension Device, Product No. 798-7; retrieved from http://www.hazet.de/eng/katalog/suche_t2.asp?F=798%2D7, retrieved on Sep. 7, 2006.

Hazet—Hose Clamp Pliers, Product No. 798-12 retrieved from http://www.hazet.de/eng/katalog/suche_t2.asp?F=798%2D12, retrieved on Sep. 7, 2006.

Lisle Corporation catalog, p. 50—Flat Band Hose Clamp Pliers, Product No. 17100; and Universal Hose Clamp Remover, Product No. 35610 (U.S. Patent No. 6,634,258).

Hose Clamp Pliers—Large #3444; Product ID 70685 retrieved from http://www.toolsource.com/hose-clamp-pliers-large-p-70658.html retrieved on Sep. 25, 2007.

2 Pc Hose Clamp Pliers Set—p. 18; EDP #28655 retrieved from http://www.nxtbook.com/nxtbooks/pelland/mayhewtools.

Schley Universal Hose Pliers, Item #2663; Schley 96600 retrieved from http://www.shoptools.com/shopdisplayproducts.asp?id=199&cat=Hose+Clamp+Pliers, retrieved on Sep. 12, 2007.

Hose Clamp Pliers—#9409; Product #92887 retrieved from http://www.toolsource.com/hose-clamp-pliers-p-92887.html?sourceid=bizrate retrieved on Sep. 12, 2007.

Invention Disclosure Agreement No. 03-240 dated May 19, 2003 from Patrick B. Becker regarding flat hose clamp remover/replacer.

Idea Disclosure Agreement No. 05-469 dated Oct. 4, 2005 from Richard D. Thayer regarding spring band clamp removal tool.

Invention disclosure "Tool for Removal and Installation of Spring Steel Hose Clamp" by Mr. M. David Johnson—Dec. 10, 1970.

Letters from Joseph E. Soares dated Oct. 24, 1972 and Nov. 10, 1972 relating to tool for installation and removal of spring hose clamps.

Invention Disclosure Agreement dated Nov. 9, 1991 from Patrick Louie relating to "GM Spring Type Hose Clamp Tool".

Invention Disclosure Agreement No. 95-391 dated May 10, 1995 from Mark Vega regarding tool for removal of spring type hose clamps.

Invention Disclosure Agreement No. 95-392 dated May 10, 1995 from Mark Vega regarding tool for removal of spring type hose clamps.

Invention Disclosure Agreement No. 95-747 dated Oct. 17, 1995 from Ted A. Swanson III regarding spring steel radiator and heater hose clamp compressor.

Invention Disclosure Agreement No. 97-007 dated Dec. 23, 1996 from Andrew R. Levin regarding tool for removal and installation of water and radiator hoses.

Invention Disclosure Agreement No. 97-016 dated Jan. 4, 1997 from Michael A. Pitts regarding tool for removal of spring clamps on vehicles.

Invention Disclosure Agreement No. 91-103 dated Feb. 18, 1997 from Chris J. Lagattata regarding clamp opening tool.

Invention Disclosure Agreement No. 97-250 dated Apr. 14, 1997 from John Hurley regarding tool to remove and replace spring clamps.

Invention Disclosure Agreement No. 98-087 dated Feb. 5, 1998 from Jaime S. Lazarus regarding automotive hose clamp tool.

Invention Disclosure Agreement No. 99-116 dated Feb. 15, 1999 from Ken Elzinga regarding flat band hose clamp tool or constant tension clamp tool.

Invention Disclosure Agreement No. 99-117 dated Feb. 21, 1999 from George O. Garcia regarding vertical hose clamp tool.

Invention Disclosure Agreement No. 99-175 dated Mar. 18, 1999 from Randall D. Hetrick regarding hose clamp compressor.

Invention Disclosure Agreement No. 99-197 dated Mar. 17, 1999 from Larry V. Wiedemeier regarding radiator/heater hose clamp removers.

Invention Disclosure Agreement No. 99-461 dated Aug. 19, 1999 from Jonathan K. Kelley regarding tension type hose clamp compressor tool.

Invention Disclosure Agreement No. 00-112 dated Mar. 14, 2000 from Vern A. Lawson regarding spring clamp tool.

Invention Disclosure Agreement No. 00-119 dated Feb. 29, 2000 from Robert Jancewicz regarding spring type hose clamp remover.

Invention Disclosure Agreement No. 00-243 dated Jun. 4, 2000 from Richard A. Mienko regarding hose clamp compressor.

* cited by examiner 44
42
40
34
36
24
26
22
32
28
30
20
35

22
23
20
23
21
21
32
27
25
36
39
34
41
33
59
26
29
54
48
28
66
56
52
31
58
24
30
60

HOSE CLAMP REMOVAL AND INSTALLATION TOOL

CROSS REFERENCE TO RELATED APPLICATION

This is a continuation-in-part application incorporating by reference and claiming priority to previously filed co-pending utility application Ser. No. 11/509,943 filed Aug. 25, 2006 entitled "Hose Clamp Removal and Installation Tool" and provisional application Ser. No. 60/596,316 filed Sep. 15, 2005 entitled "Spring Band Clamp Removal Tool".

BACKGROUND OF THE INVENTION

In a principal aspect, the present invention relates to a tool for installation and/or removal of a hose clamp type in the form of a generally circular band or wire ring with at least first and second projecting end tangs that may be engaged to move toward one another and thereby expand the circumference of the band to release the band from a hose or other clamping operation performed by the band.

Hose clamps are often utilized in the automotive field and for numerous other purposes to retain a hose inserted or fitted onto a tubular shaft, hose fitting or stem. A hose clamp is typically fabricated from metal formed in a circular or other closed loop shape which, when fitted over a hose, will compress the hose onto a shaft or tube. Such hose clamps are generally formed from flat stock or wire and include projecting end tangs which may be compressed or moved toward one another to overcome the elastic forces provided by the clamp wire or band material and thereby enable release of the clamp from the hose or other item to which the hose clamp is attached. That is, when replacing a hose attached to mechanical equipment, it is often necessary to remove the hose and therefore initially detach the hose clamp which holds the hose in a fixed position on a tube, for example.

Various tools have been proposed to effect such a release of a hose clamp. For example, Thexton offers a hose clamp tool having sku number THX461 which includes a tube having closed opposite ends with a longitudinal slot in the tube extending between the ends of the tube. A moveable plate is incorporated in the tube so that the tangs projecting from a hose clamp may be engaged and compressed between the moveable plate and one end of the tube to thereby expand and release the clamp.

Steck Co. offers a hose clamp tool especially designed for hose clamps made from rod like material or wire. The Steck tool is very similar to the Thexton tool described above.

While such tools provide some functionality which achieves the objective of engaging and holding a hose clamp in an open position, the design of such tools may not provide desired benefits or advantages. For example, a tool construction which may be easily utilized with multiple types of hose clamps is desired, particularly a hose clamp that will be useful with hose clamps made from flat stock as well as rod or wire stock. Further, a tool construction which insures that the hose clamps will be appropriately aligned and engaged by a clamp release tool or device is desired. These among other desirable features have led to the development of the present invention.

SUMMARY OF THE INVENTION

Briefly, the present invention comprises a hose clamp removal tool or device of a type designed to engage the projecting tangs located respectively at the first and second ends of a hose clamp band as well as the projecting tangs of a hose clamp fabricated from wire or rod. The hose clamp tool is thus effective for use with hose clamps having the shape of a flat band of metal which has a generally circular form with projecting end tabs or tangs. The same hose clamp tool may also be usable with hose clamps of a type made from wire, as well as non-circular clamps.

The hose clamp removal tool includes first and second cylindrical parallel rails connected together by opposed, spaced end plates. An intermediate slide plate is slidably mounted on the rails between the first and second, spaced end plates that are affixed to the parallel rails. The slide plate is threadably engaged by a threaded rod, that is, journaled at opposite ends in the first and second end plates and thus is slidably movable between the first and second end plates upon rotation of the threaded rod. The slide plate and opposed first end plate each include a tang engagement member which, in a disclosed embodiment, comprises a transverse slot and a guide ramp which facilitates positioning of the tangs or ends of a hose clamp within the clamp device between the slide plate and a fixed end plate. Additionally, the slide plate and opposed first end plate each include at least one off center slot or channel extending normal to the transverse slot in the respective plates, each slot sized to engage circular cross section tangs of circular cross section or wire hose clamps.

The rails of the hose clamp are spaced laterally, one from the other, in a manner which facilitates alignment of a band type hose clamp appropriately between the rails. The rails function to preclude slippage of the band hose clamp from the hose clamp tool during operation of the tool. The band hose clamp tool may thereby be engaged with the tangs of a hose clamp to thereby effectively open or spread the hose clamp. The tool may remain engaged with the band style hose clamp and facilitate replacement of the band hose clamp on a hose once a repair or replacement operation has been effected.

The ring or wire type hose clamp is maintained against slippage by the slots in the opposed end plate and slide plate. The slots in the end plate and slide plate are equidistant from the center line axis between the parallel rails to avoid skewing of the clamp upon removal.

Thus, it is an object of the invention to provide an improved hose clamp tool.

It is a further object of the invention to provide a hose clamp tool which facilitates maintenance of a hose clamp in engagement with the hose clamp tool for band type and ring or wire type hose clamps.

Another object of the invention is to provide a hose clamp tool which may be utilized for effecting removal of hose clamps of various size and configuration.

Another object of the invention is to provide a hose clamp tool which is rugged, easy to use, compact, capable of being made in various sizes, useful in restricted spaces, capable of use in combination with a socket type drive, and generally inexpensive.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF EMBODIMENTS

Figure 1:
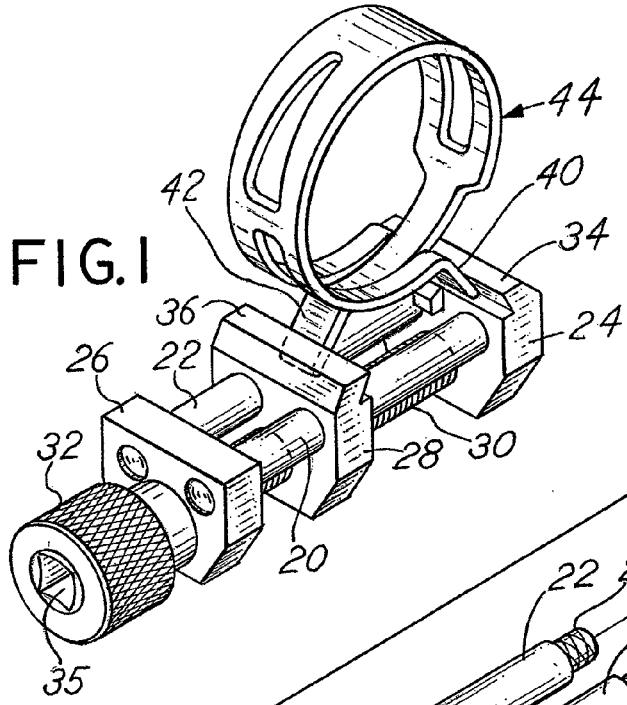
FIG. 1 is an isometric view of an embodiment of the hose clamp tool of the invention.

Referring to FIGS. 1-17, a first embodiment of the hose clamp tool of the invention is comprised of a multiple number of component parts which are assembled as described herein. Those parts are depicted in an exploded isometric view (FIG. 2) and can be summarized as follows. The tool includes first and second, parallel generally cylindrical rails 20 and 22. The first and second rails 20, 22 are designed to connect a fixed, spaced first plate 24 to a second or parallel base plate 26 which is also affixed to and spaced from the first or fixed plate 24. A parallel sliding plate 28 is slidably mounted on the first and second rails 20 and 22 and is threadably engaged by a rotatable, threaded rod 30 journaled through first plate 24 and second or base plate 26. Rod 30 is situated beneath rails 20, 22 with engagement elements or opposed jaws 34, 36 on opposed jaws 24, 28, respectively, situated above and along the upper side of the rails 20, 22. Rod 30 may be rotated by means of attached knob 32 to move the sliding plate 28 with jaw 36 axially between first plate 24 and second plate 26. Note, therefore, that the fixed plates 24 and 26 remain parallel at a fixed, spaced distance. Further, the first fixed plate 24 includes the tang engagement element or member or jaw 34 positioned in opposed relationship to tang engagement element or member or jaw 36 of the sliding jaw 28.

Figure 2:
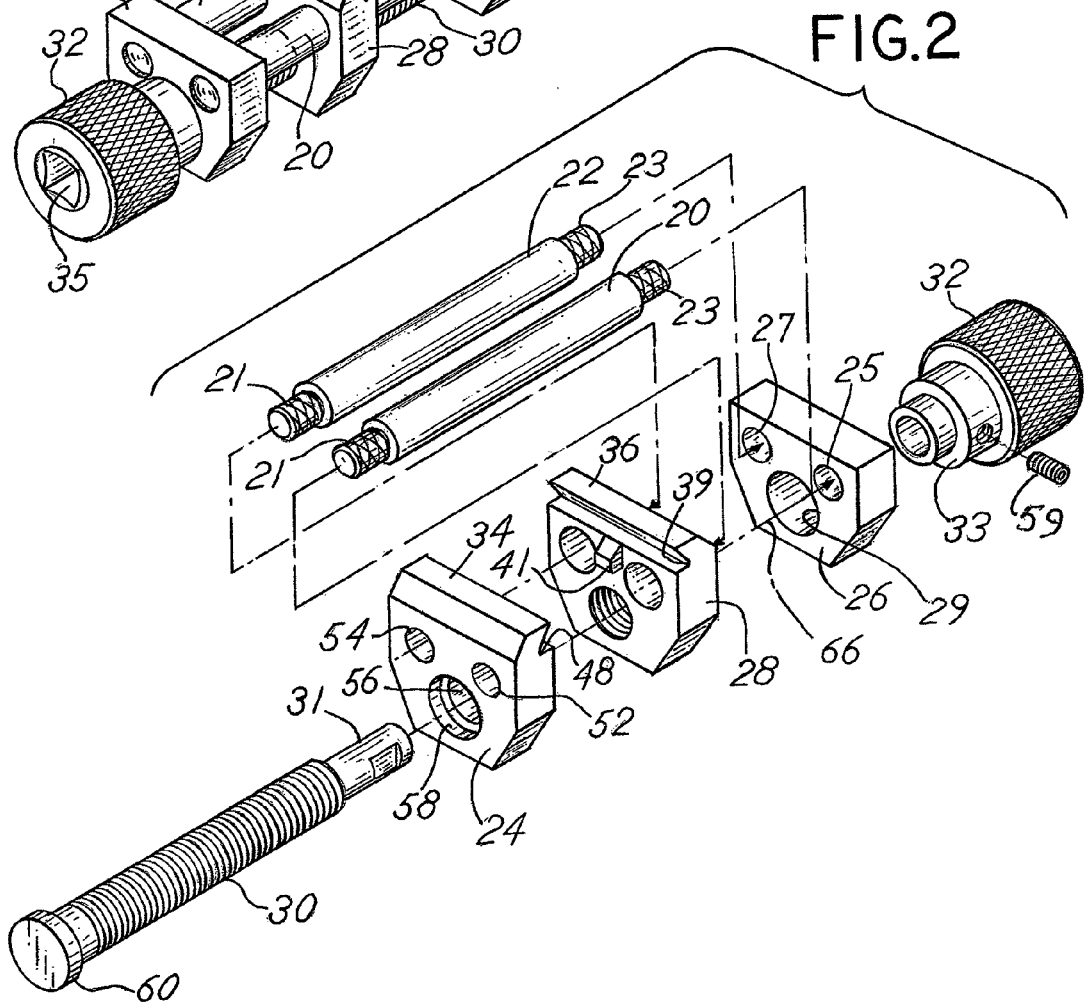
FIG. 2 is an exploded isometric view of the tool of FIG. 1.
Figure 3:
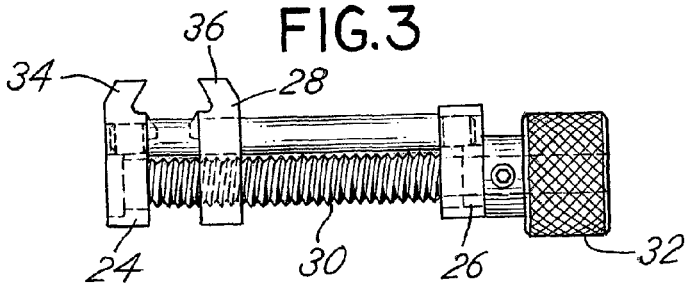
FIG. 3 is a side elevation of the assembled tool of FIG. 1.
Figure 4:
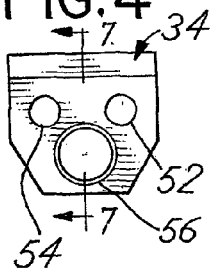
FIG. 4 is an end view of an end plate for the tool of the embodiment of FIG. 1 comprising a fixed jaw.
Figure 5:
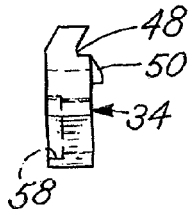
FIG. 5 is a side view of the plate and jaw of FIG. 4.
Figure 7:
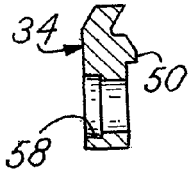
FIG. 7 is a cross sectional view of the plate and jaw of FIG. 4 taken along the line 7-7.
Figure 6:
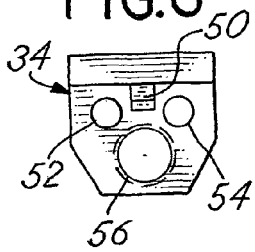
FIG. 6 is an opposite side view of the plate and jaw of FIG. 4.
Figure 8:
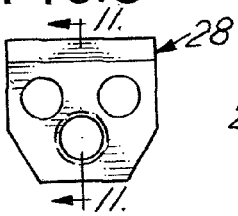
FIG. 8 is a side view of a sliding jaw of the embodiment of FIG. 1.
Figure 9:
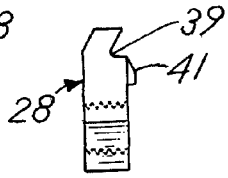
FIG. 9 is a side view of the sliding jaw of FIG. 8.
Figure 11:
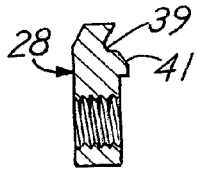
FIG. 11 is a cross sectional view of the sliding jaw of FIG. 8 taken along the line 11-11.
Figure 10:
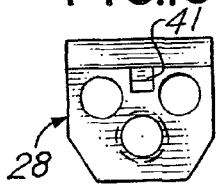
FIG. 10 is an opposite side view of the sliding jaw of FIG. 8.

The tool in the assembled condition, for example as illustrated in FIGS. 1 and 3 is designed to cooperate with and engage the opposite end tabs or tangs 40 and 42 of a band type hose clamp 44. The hose clamp 44 typically has the form of a flat elongate, generally circular band of material. FIG. 1 depicts a typical type of a band hose clamp 44. The hose clamp 44 is made from an elastomeric material, typically steel, and is designed to fit around a hose to compress the hose on a tube or stem. By engaging the opposed, radially extending or generally radially extending and aligned tabs or tangs 40 and 42 and by moving those tangs 40, 42 toward one another by means of a clamp tool, the elastic pressure exerted on a hose by a band or clamp 44 can be released and the attached hose can then be removed or disengaged from a tube or stem or the like.

Such clamp devices 44 may typically be found in automobile engines where they maintain hose connections for cooling systems and other fluid systems associated with an internal combustion engine. However, hose clamps are used in a myriad of environments and have a myriad of shapes and configurations. The embodiment of the tool of the invention, therefore, is designed for utilization in a broad range of applications and thus such tools are generally universal tools having the function of opening or increasing the diameter of a hose clamp and maintaining that diameter in a fixed, open position and subsequent release thereof.

Figure 14:
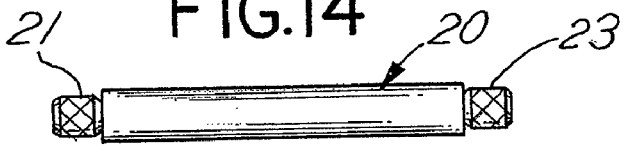
FIG. 14 is a side view of a rail of the embodiment of the tool of FIG. 1.
Figure 15:
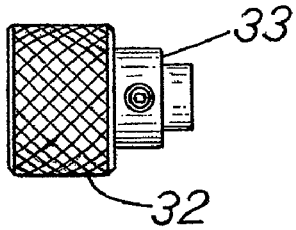
FIG. 15 is a side view of the knob which is used to rotate a threaded rod that is incorporated in the tool of the embodiment of FIG. 1.
Figure 16:
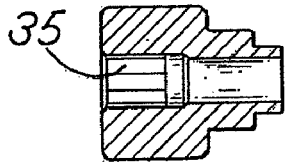
FIG. 16 is a cross sectional view of the knob of FIG. 15.

The remaining figures illustrate some of the important features of the invention and as employed in the embodiment depicted. For example, the so-called first fixed plate 24 is depicted in FIGS. 4-7. That first plate 24 includes a tang engagement element or jaw 34 which comprises a transverse slot 48 into which the end of a hose clamp tang (e.g. 40) may be situated or placed. A ramp member 50 is provided on the inside face of the fixed plate 24. The first fixed plate 24 further includes first and second passages 52 and 54 therethrough designed to receive and engage the knurled end of first and second rails 20 and 22, respectively. A typical rail, such as rail 20, is depicted in FIG. 14 and includes opposite, reduced diameter knurled ends 21 and 23 which are designed to engage, for example, openings 52 and/or 54, respectively, and thereby be retained in those openings 52, 54. A central passage 56 through the fixed plate 24 includes a counterbore 58 which cooperates with a flange 60 at one end of the threaded rod 30.

Figure 17:
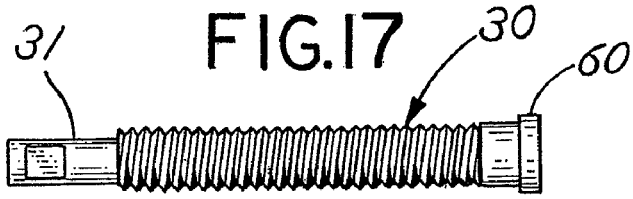
FIG. 17 is a side elevation of the threaded shaft or rod which is incorporated into the embodiment of the tool of FIG. 1 and is connected to the knob of FIG. 15.

Rod 30 is depicted in greater detail in FIG. 17 wherein the flange 60 which fits into the counterbore 58 is shown. Thus, the rod 30 is rotatable about its longitudinal axis 66 and is journaled to the first and second, parallel end plates 24, 26.

The ramp 50 associated with the fixed plate 24 is inclined inwardly toward the transverse slot 48 and facilitates maintenance of a tang 40 or 42 of hose clamp 44 appropriately in line and retained within the transverse slot 48.

Figure 12:
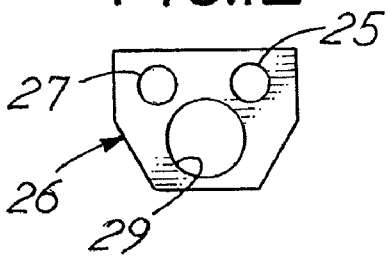
FIG. 12 is an end view of a base jaw of the embodiment of FIG. 1.
Figure 13:
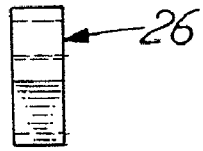
FIG. 13 is a side view of the base jaw of FIG. 12.

FIGS. 12 and 13 illustrate the base plate 26 or in other words the second fixed plate 26 that cooperates with and is held to the opposite end of the rails 20 and 22 by engagement of knurled, reduced diameter sections 21 or 23 with openings or passages 25 or 27 of the base plate 26. The base plate 26 further includes a passage 29 for journaled and rotatable receipt of the reduced diameter end 31 of the rod 30. Reduced diameter end 31 fits through a compatibly sized passage in the plate 26 and is fastened to knob 32 by a transverse set screw or pin 59 depicted in FIG. 1. The knob 32 thus may be pinned to the reduced diameter end 31 of the rod 30. The knob 32 may be knurled on its outside face to facilitate rotation of the knob 32. The knob 32 includes a land 33. The knob 32 further may include a socket opening 35 at its outside end to facilitate engagement by a socket tool to enable driving of or rotation of the rod 30 by means, for example, of a wrench or another tool. This enables providing a mechanical advantage when attempting to rotate the rod 32 to open a hose clamp.

FIGS. 8-11 illustrate in greater detail the sliding plate 28 with its tang engagement member or jaw 36. The tang engagement member or jaw 36 includes a transverse slot 39 and further includes a ramp 41 which are designed as a generally mirror image companion to the slot 48 and ramp 50 associated with jaw 34 of the fixed plate 24. The construction of the tang engaging member 36 of the sliding plate 28 and that of the fixed plate 24 are substantially identical and in the construction of the tool depicted in the drawings these tang engagement members or elements or jaws 34, 36 are arranged in opposed relation so that they can engage and hold the end tangs 40, 42 of a band type hose clamp 44.

Among the features which are considered to be generally important with respect to the construction described is the spacing of the rails 20 and 22. The first and second rails 20 and 22 are spaced so that they may engage the outside edges or portions of the outside edges of the tangs 40, 42 of a hose clamp 44 and thus retain the band type hose clamp 44 aligned appropriately and axially in the hose clamp tool. In other words, the rails 20, 22 attempt to preclude the hose clamp 44 and more particularly the tangs 40, 42 of the hose clamp 44 from slipping laterally. Thus, the tangs 40, 42 of a hose clamp 44 may fit between the rails 20, 22 or alternatively be otherwise restrained laterally by the engagement thereof with the sides of the tangs 40, 42 of the hose clamp.

Another feature relates to the portion of the axially extending rails 20, 22 intermediate the generally parallel rod 30 and the jaws 34, 36. At least in part due to this arrangement of parts, the torsional or twisting forces on rails 20, 22 are balanced. That is, the intermediate positioning of the rails 20, 22, generally equally between slots 39, 48 and rod 30, is a very stable clamping arrangement and also effectively protects the threads of the rod 30.

In use, the sliding plate 28 is appropriately spaced from the fixed plate 24. The jaws 34 and 36 are then aligned with and engaged with the tangs 40 and 42 of the hose clamp 44 and the knob end 32 and rod 30 are rotated to compress the tangs 40 and 42 between the jaws 40 and 42. Because of the design of the tool, the jaws 40, 42 and thus the hose clamp tool itself will remain engaged with a hose clamp even if the clamp has been removed from a hose, tube or stem or the like. This provides an advantage to a mechanic or other individual using the hose clamp tool in that the hose clamp tool may remain in position on a hose clamp after the hose clamp is effectively opened. By remaining on the hose clamp, the hose clamp can be more easily repositioned on the hose and otherwise adjusted for positioning over a hose without further mechanical operations or reattachment of another hose clamp tool.

FIGS. 18-34 illustrate a second embodiment of the invention. The second embodiment of the invention is similar to the first embodiment but includes additional features which enable the hose clamp compression tool to be much more utilitarian. That is, the tool may be utilized for not only band type hose clamps, but also with respect to ring type or wire type hose clamps. Thus, FIGS. 17-34 include features enabling enhanced utility with respect to band type as well as wire type hose clamps. In that respect, the component parts of the compression tool of FIGS. 17-34 are substantially similar and are numbered similarly in those figures except for the following description which is directed to the additional features that enable the additional functionality described.

Referring therefore to FIGS. 17-34 the hose clamp tool or compression tool of those figures is designed to be useful with respect to a ring or wire type hose clamp 144 of the type which includes end tangs 140 and 142. The end tangs 140 and 142 are circular cross section wire elements. The compression tool is constructed so that each tang or end segment 142 or 140, respectively, will fit into a semi-circular channel 102 or 104 associated, respectively, with the slidable plate 28 and fixed plate 24. The channel 104 is a channel which extends transversely to the slot 39 of the slidable plate 28 and channel 102 is transverse to the slot 48 of the fixed plate 24. Slots 102, 104 are offset laterally in opposite directions from a center line axis 108, 106, respectively of the plates 24, 28. Thus, the channel 104 extends upwardly from the slot 39 and is offset to the left in FIG. 28 from the center line axis 106. This construction is shown in FIGS. 25-28.

Figure 18:
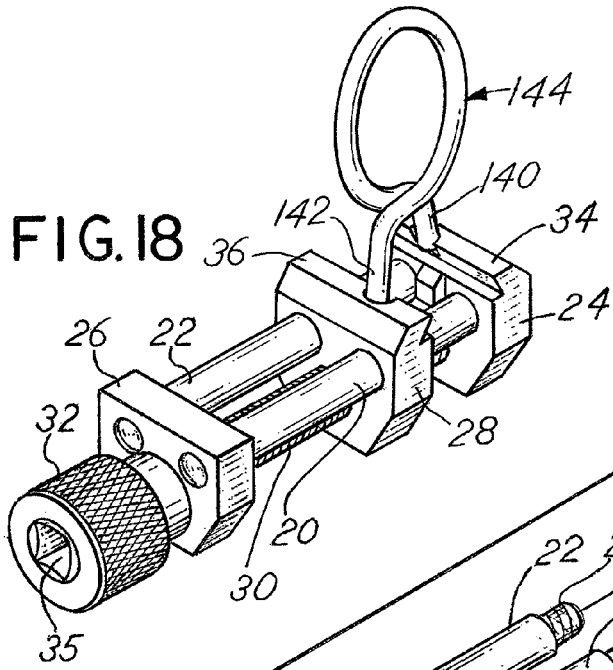
FIG. 18 is an isometric view of an alternative embodiment of the hose clamp tool of the invention.
Figure 19:
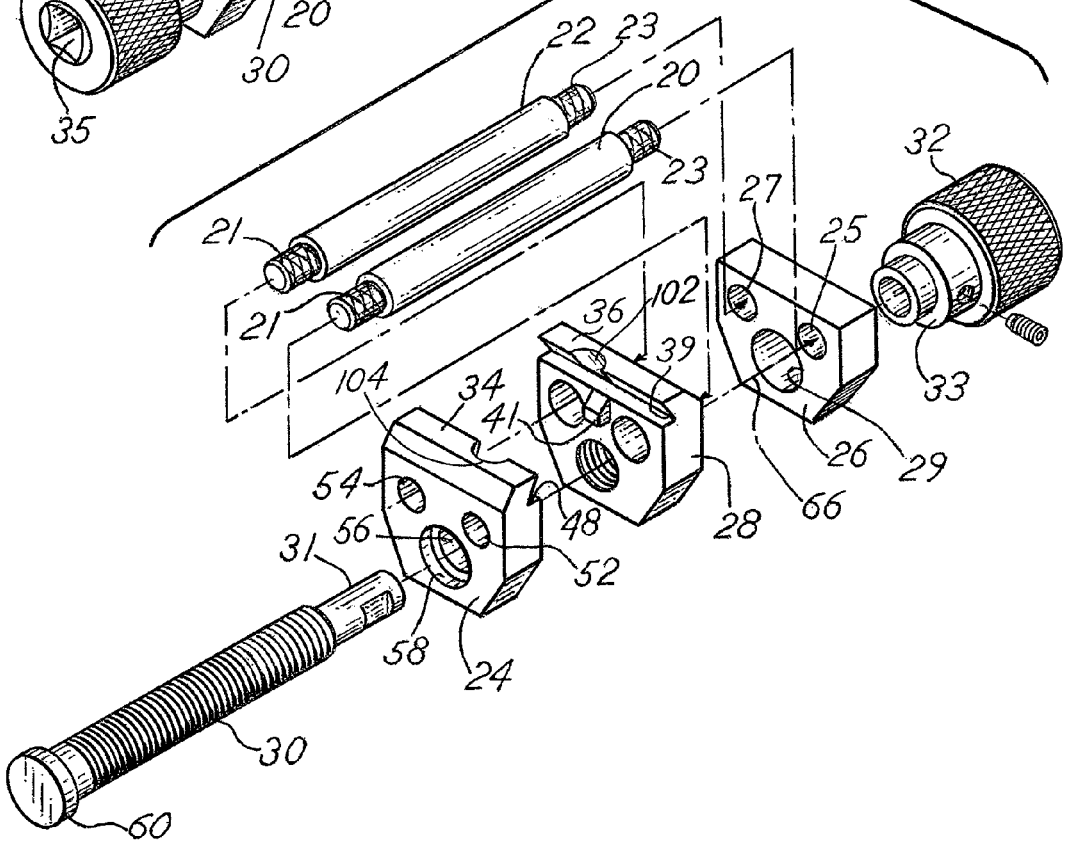
FIG. 19 is an exploded isometric view of the tool of FIG. 18.
Figure 20:
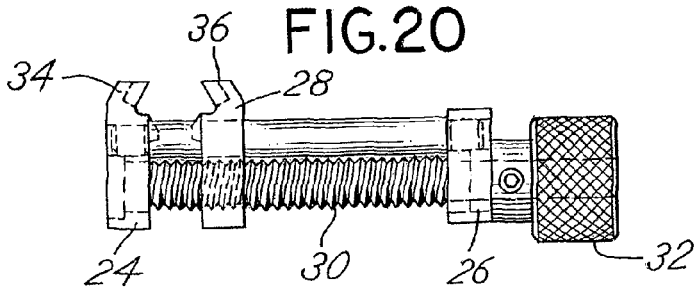
FIG. 20 is a side elevation of the assembled tool of FIG. 18.
Figure 21:
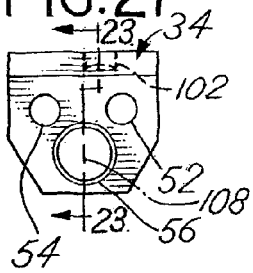
FIG. 21 is an end view of an end plate for the tool of the embodiment of FIG. 18 comprising a fixed jaw.
Figure 22:
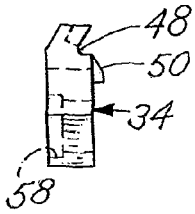
FIG. 22 is a side view of the plate and jaw of FIG. 21.
Figure 23:
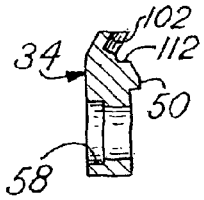
FIG. 23 is an opposite side view of the plate and jaw of FIG. 21.
Figure 24:
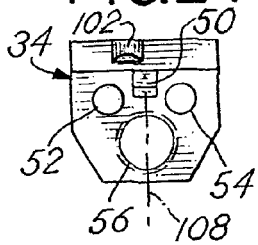
FIG. 24 is a cross sectional view of the plate and jaw of FIG. 21 taken along the line 24-24.
Figure 25:
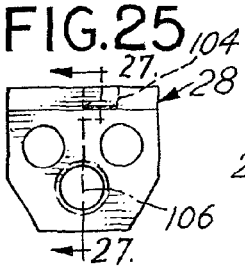
FIG. 25 is a side view of a sliding jaw of the embodiment of FIG. 18.
Figure 26:
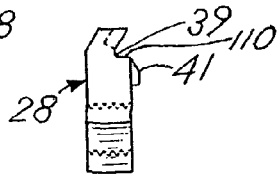
FIG. 26 is a side view of the sliding jaw of FIG. 25.
Figure 27:
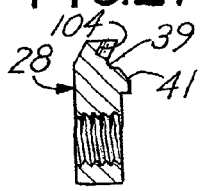
FIG. 27 is an opposite side view of the sliding jaw of FIG. 25.
Figure 28:
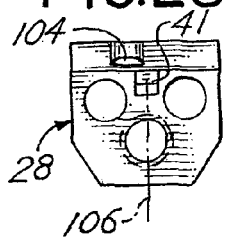
FIG. 28 is a cross sectional view of the sliding jaw of FIG. 25 taken along the line 28-28.
Figure 29:
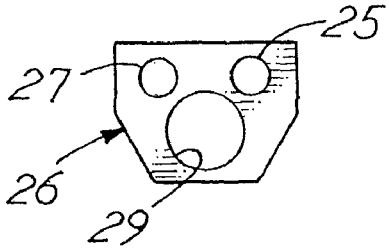
FIG. 29 is an end view of a base jaw of the embodiment of FIG. 18.
Figure 30:
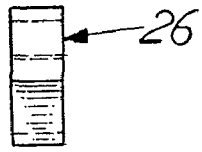
FIG. 30 is a side view of the base jaw of FIG. 29.
Figure 31:
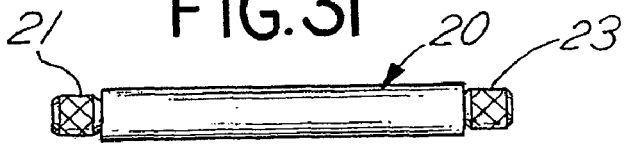
FIG. 31 is a side view of a rail of the embodiment of the tool of FIG. 18.
Figure 32:
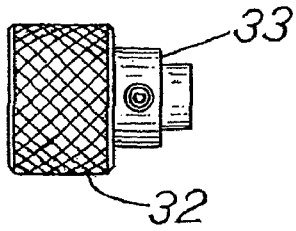
FIG. 32 is a side view of the knob which is used to rotate a threaded rod that is incorporated in the tool of the embodiment of FIG. 18.
Figure 33:
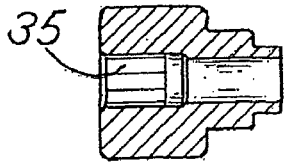
FIG. 33 is a cross sectional view of the knob of FIG. 32.
Figure 34:
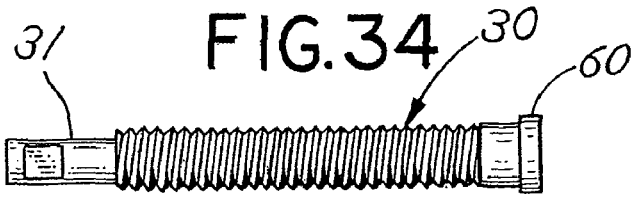
FIG. 34 is a side elevation of the threaded shaft or rod which is incorporated into the embodiment of the tool of FIG. 1 and is connected to the knob of FIG. 32.

In a similar fashion the fixed plate 24 depicted in FIGS. 21-24 includes a slot 102 which is offset from the axis 108 at an equal distance to the offset of the slot 104 from the axis 106. The slot 102, when assembled in opposition to the slot 104 as the plate 24 is arrayed in opposed relation to the plate 28, provides that the channels 102 and 104 are offset an equal distance from a center line axis intermediate midway between rails 20, 22 associated with the compression tool. In as much as the ring or wire type clamp 144, and more particularly the end tabs 140 and 142 are offset from one another, placement of those end tabs 140, 142 in the channels 104 and 102, respectively, as illustrated in FIG. 18 enables a balancing of the forces on the wire clamp 144. Avoidance of unnecessary torque and the maintenance of a balanced force on the wire clamp 144 are maintained by virtue of the compression tool of FIGS. 18-34 as the plate 28 moves toward plate 24 with jaws 36 and 34 engage the clamp 144.

Alternatively, a band type wire clamp, such as illustrated in FIG. 1, may still be utilized and compressed using the second embodiment compression tool inasmuch as the cross channels such as the channels 39 and 48 are maintained in the embodiment of FIGS. 18-34. As a consequence, the construction of the embodiment of FIGS. 18-34 is useful with both a band type hose clamp as well as a wire type hose clamp and may be used in a manner which provides for avoidance of torqueing or twisting the hose clamp as it is removed regardless of the type of the clamp that is being used. The channels 102 and 104, of course, may be sized so as to be cooperative with multiple sizes or gauge of wire associated with a wire or ring type clamp 144. Each channel 102, 104 subtends or generally bottoms against a surface, such as the surface 110, of the slot 39 subtending the channel 104, and the surface 112 of the slot 48 subtending the channel 102. The surfaces 112 and 110 comprise a means for limiting or fixing the movement of the wire tangs 140, 142 and thereby facilitate positioning those tangs 140, 142 properly in combination with the plates 24 and 28.

Certain variations of the tool may be adopted to accommodate the utilization thereof and still comprise practice of the invention. For example, the rails may be interconnected rather than comprising two separate rods. As interconnected members, they may define an intermediate channel which acts as a guide for a projecting dovetail or arm extending from the moveable jaw and thereby eliminate the sliding connection of the moveable jaw on rails or equivalent structure. The spacing of the rails and their particular engagement of spaced openings associated with the fixed plates 24 and 26, however, is believed to be a preferable embodiment in order to facilitate the manufacture of the tool from parts that are easily assembled. The rails may also assume any of a variety of cross sectional shapes keyed to passages in the moveable jaw. The knurled knob may be of various sizes and shapes; for example, it may have an external hexagonal shape. The mechanism for moving the sliding or moveable jaw may be altered; for example, a piston to effect movement of the moveable jaw on a cylindrical rod or other smooth surface rod shape. Thus, while there has been set forth a preferred embodiment of the invention, it is to be understood that the invention is limited only by the following claims and equivalents thereof.

What is claimed is:

1. A hose clamp compression tool for engaging and compressing a hose clamp band or a hose clamp wire ring, said band including a first and a second outwardly projecting end tang, said first and second tangs in spaced relation and moveable toward one another to expand the circumference of the band, said wire ring including offset opposite end tangs, said tool comprising, in combination:

first and second spaced, generally parallel cylindrical rails, each rail having first and second spaced ends;

first and second fixed end plates attached respectively to the first end and second end of the first rail and the second rail;

a slide plate slidably mounted on the rails intermediate the first and second end plates, said plates arranged in parallel array;

a threaded cylindrical rod journaled to said first and second end plates and threaded through said slide plate, said rod generally parallel to, and midway between, the rails and rotatable to effect sliding movement of the slide plate on said rails, said rod projecting axially from at least one of said fixed end plates and positioned on a first side of said rails;

said first end plate and said slide plate each including an outwardly projecting tang engagement member extending transversely to said rails on the side of said rails generally opposite the first side, said tang engagement members shaped to engage respectively a first said tang and a second said tang of a said hose clamp band to enable altering the spacing of said hose clamp band tangs upon rotation of said rod, said tang engagement member of said slide plate and said first end plate each including a slot transverse to the axial rod;

said slide plate and said first fixed end plate each further comprising:

a channel normal to and connected to the respective transverse slot, the respective channels of the slide plate and the first end plate laterally spaced from each other and at an equal distance from the axis of the rod and on opposite sides of the axis of the rod, said slots including a support surface subtending the channels to limit the location of a wire tang in each of the respective channels;

said rails laterally spaced from each other.

2. The tool of claim 1 wherein said rod includes a manual actuation knob attached to an end of said rod.

3. The tool of claim 1 wherein said rod includes a drive socket.

4. The tool of claim 2 wherein said rod includes a drive socket.

5. The tool of claim 1 further including a tang guide ramp at least on one of said first end plate and slide plate, said ramp intermediate said rails.

6. The tool of claim 1 wherein said threaded rod includes a flange at one end and a reduced diameter section at the opposite end, and wherein one of said fixed end plates includes a counterbore for said flange and the other of said fixed end plates includes a throughbore for said reduced diameter section, and wherein said reduced diameter section projects axially from the other fixed end plate and said knob is attached to said projecting reduced diameter section to retain the spaced, fixed end plates from axially spreading.

* * * * *

UNITED STATES PATENT AND TRADEMARK OFFICE

CERTIFICATE OF CORRECTION

PATENT NO. : 7,966,911 B2
APPLICATION NO. : 12/424173
DATED : June 28, 2011
INVENTOR(S) : Richard D. Thayer It is certified that error appears in the above-identified patent and that said Letters Patent is hereby corrected as shown below:

Column 3, line 35:
Delete “23” and insert --27--.
Delete “side” and insert --end--.

Column 3, line 37:
Delete “24” and insert --23--.

Column 3, line 38:
Delete “24–24” and insert --23–23--.

Column 3, line 39:
Delete “side” and insert --end--.

Column 3, line 42:
Delete “27” and insert --28--.
Delete “side” and insert --end--.

Column 3, line 44:
Delete “28” and insert --27--.

Column 3, line 45:
Delete “28–28” and insert --27–27--.

Column 6, line 9:
Delete “17” and insert --18--.

Column 6, line 12:
Delete “17” and insert --18--.

Signed and Sealed this
Twenty-second Day of November, 2011

David J. Kappos

David J. Kappos
*Director of the United States Patent and Trademark Office*

Column 6, line 16:
Delete “17” and insert --18--.